US005476110A

United States Patent [19]

Baig et al.

[11] Patent Number: 5,476,110

[45] **Date of Patent: *Dec. 19, 1995**

[54] WATER PIPE

[76] Inventors: Mirza H. A. Baig; Mukarram M. Baig, both of 4219 Dustin Rd., Burtonsville, Md. 20866

[ * ] Notice: The term of this patent shallnot extend beyond the expiration date of Pat. No. Des. 351,253.

[21] Appl. No.: 317,659

[22] Filed: Oct. 3, 1994

Related U.S. Application Data

[63] Continuation-in-part of Ser. No. 16,123, Dec. 8, 1993, Pat. No. Des. 351,253.

[51] Int. Cl.[6] ..... A24F 1/02

[52] U.S. Cl. ..... 131/173

[58] Field of Search ..... 131/173; 220/210, 220/233, 235, 288; D27/162

[56] References Cited

U.S. PATENT DOCUMENTS

| | | | |
|---|---|---|---|
| 77,096 | 4/1868 | Robbins . | |
| 110,594 | 12/1870 | Selfe . | |
| 183,626 | 10/1876 | Bingham . | |
| D. 351,253 | 10/1994 | Baig et al. | D27/162 |
| 2,348,589 | 5/1944 | Auten | 220/235 X |
| 2,520,859 | 8/1950 | Smith | 220/233 X |
| 2,805,670 | 9/1957 | Wang . | |
| 2,815,030 | 12/1957 | Wenger | 131/173 |
| 3,250,280 | 5/1966 | Hu . | |
| 3,703,179 | 11/1972 | Nubla . | |
| 3,902,506 | 9/1975 | Hawie | 131/173 |
| 4,044,781 | 8/1977 | Heggestuen | 131/173 |
| 4,096,868 | 6/1978 | Norman | 131/173 |
| 4,111,213 | 9/1978 | Shanto et al. | 131/173 |
| 4,170,237 | 10/1979 | Epstein | 131/173 |
| 4,198,993 | 4/1980 | Martin et al. | 131/173 |
| 4,648,410 | 3/1987 | Seroussi | 131/173 |
| 5,080,113 | 1/1992 | Bui | 131/173 |

*Primary Examiner*—Jennifer Bahr
*Attorney, Agent, or Firm*—Richard C. Litman

[57] ABSTRACT

The present invention relates to a water pipe for filtering the smoke from cigarettes. The water pipe includes a water chamber having an open upper end, a releasible closure for sealing the open upper end of the water chamber, a first and second opening through the water chamber, both of the first and second openings located adjacent to the open upper end of the water chamber, a smoke inlet tube passing through said first opening and configured to frictionally engage a cigarette or cigar, and a hollow stem passing through said second opening and terminating in a mouthpiece.

6 Claims, 8 Drawing Sheets

WATER PIPE

BACKGROUND OF THE INVENTION

This application is a continuation-in-part of application Ser. No. 29/016,123, filed Dec. 8, 1993 now U.S. Pat. No. Des. 351,253.

FIELD OF THE INVENTION

The present invention relates to smoking apparatus. More specifically, the present invention relates to a water pipe which filters harmful hydrocarbons and nicotine from conventional tobacco cigarettes.

DESCRIPTION OF THE PRIOR ART

Human beings of all cultures, races, and religions have been smoking various leafy vegetable materials for millennia. From Turkish hookahs, to Native American Peace Pipes, to Sherlock Holmes' ubiquitous briar pipe, the act of concentrating and inhaling the smoke from a burning substance has been part of the human experience since its earliest beginnings.

In the Western World, smoking became an important centerpiece of American commerce when tobacco was introduced to European consumers in the middle 1600's. Throughout all of 18th century, and into the early 19th century, tobacco remained the primary cash crop of the American Eastern Seaboard. Only as the United States approached the outset of the Civil War did the value of cotton exports exceed the value of tobacco exports.

However, it was not until the 20th century that smoking cigarettes became popular in American culture. Cigarette smoking in the U.S. increased steadily throughout both World War I and World War II, in spite of the increasing scientific evidence that linked cigarette smoking with two previously rare lung diseases: lung cancer and emphysema.

In the 1950's, with the increasing public perception that cigarette smoking and lung cancer were linked, filtered cigarettes were first mass-marketed in the U.S. They quickly began outselling unfiltered cigarettes. Tests had shown that some, but not all, of the integral filters placed in cigarettes lowered the amount of "tar," (heavy hydrocarbon substances), and nicotine which were inhaled by the consumer. Both "tar" and nicotine had been shown to be carcinogenic and mutagenic under certain laboratory conditions.

Then, on Jan. 11, 1964, U.S. Surgeon General Luther Terry issued the now-famous report linking smoking with lung cancer. Actually, the report was a review and summary of evidence that had been accumulated by scientists since the beginning of the 1950's. This date, however, is the starting point from which the present perception of cigarette smoking as an individual .and public health hazard originates.

It has now become generally accepted that smoking is a primary causative factor of lung cancer and emphysema. However, despite the health factors, as well as a federal ban on cigarette advertising on television, and ever-increasing regulations which ban smoking from most work places, restaurants, and other public areas, many Americans continue to smoke cigarettes regularly. To lower the danger of smoking, as well as to encourage smoking cessation, numerous cigarette filtering media and devices have been commercially marketed. Of relevance to the present disclosure are those devices which utilize a liquid filter media, especially water.

As a means to cool and filter smoke for inhalation, various inventors have patented smoking devices which utilize water as a filter element. For instance, an early patent to H. R. Robbins, U.S. Pat. No. 77,096, issued Apr. 21, 1868, describes a two-chambered pipe in which the bowl of the pipe is situated directly above, and communicates with, a partially water-filled housing. The conduit which connects the bowl to the housing is submersed below the water level in the housing. A mouth piece communicates with air space above the water level in the housing. By inhaling on the mouthpiece, a partial vacuum is created above the water surface. The vacuum draws air through the bowl, pulling smoke through the water and into the mouthpiece.

A more elaborate device is shown in U.S. Pat. No. 110,594, issued Dec. 27, 1870, to W. Selfs. The vertical construction of this pipe is identical to the Robbins pipe, above. However, this device functions to remove some of the tar oil from the smoke by passing the smoke over a moistened sponge placed in a space between the bowl and the lower water chamber. Also, two stopcocks are provided to allow the water chamber to be sealed from both the bowl and the stem to facilitate cleaning of the device.

Another early patent, to J. Bingham, U.S. Pat. No. 183,626, issued Oct. 24, 1876, describes a water pipe for smoking material from a bowl, a cigar, or a cigarette. The device includes a lower water chamber having a tight-sealing lid with two openings passing therethrough. A long tube passes through one of the openings and extends to near the bottom of the water chamber. A much shorter tube passes through the second opening and terminates in the air space above the -.water in the water chamber. A mouthpiece is attached to the second tube, while a pipe bowl, a cigar holding tube, or a cigarette holding tube is attached to the first tube. Again, the same vertical construction as the previous two examples is employed.

A more recent patent, U.S. Pat. No. 2,805,670, issued Sep. 10, 1957, to W. Wang, describes a cigarette filtering device which includes two concentrically disposed chambers. Smoke from a cigarette first enters the central inner chamber, where it contacts a solid filter material such as silica gel. The smoke then passes to an outer water-filled chamber, where the smoke is bubbled through the water. The smoke then passes through a stem and mouthpiece to the consumer.

A more "conventional"-looking pipe and cigarette holder are shown in U.S. Pat. No. 3,250,280, issued May 10, 1966, to Y. J. Hu. The stem of both the pipe and cigarette holder are comprised of two main body members which can be releasably fastened to one another, and which together define a filter-holding chamber. The two body members are separated, and a hermetically sealed filter element containing water is introduced into the filter-holding chamber. When the two body members are joined together, piercing elements in both body member's pierce the ends of the hermetically sealed element, thereby providing a passage for the smoke to pass from the bowl or cigarette to the consumer.

J. L. Nubla describes a smoke filtering device very similar to the Bingham device, described above, in U.S. Pat. No. 3,703,179, issued Nov. 21, 1972. The device includes a lower water-containing chamber, sealed by a cap having two openings therethrough. One opening has a smoke inlet passing therethrough, which terminates at a point below the water level in the water-containing chamber, and the other opening has a smoke outlet passing therethrough, the smoke outlet terminating in the air space above the water level in the water chamber. Both the smoke inlet and the smoke outlet pass through the cap of the device. In addition, the Nubla device includes porous filters placed within the smoke inlet, the smoke outlet, and in the air space within the water chamber. The primary drawback of this device is that the large amount of filtering media makes it difficult to easily draw smoke through the device, and makes the device very difficult to clean.

SUMMARY OF THE INVENTION

The present invention is a small, easily transportable water pipe which functions to pass cigarette smoke through a liquid filter prior to being inhaled by a consumer. The water pipe includes a water chamber having an open upper end and a releasably sealable frictional top closure, a smoke inlet tube, and a hollow stem terminating in a mouthpiece. The first end of the smoke inlet is shaped so as to frictionally engage a standard cigarette, while the other end of the smoke inlet tube is placed inside the water chamber, adjacent to the bottom surface of the chamber.

The hollow stem defines a passage from space within the water chamber to space outside the water chamber. The stem enters the water chamber through an opening in the wall of the water chamber near the open upper end of the water chamber.

In operation, the releasible closure which covers the water chamber is removed, and the water chamber is filled with a liquid, preferably water. The water level in the water chamber must not rise above the point where either the smoke inlet tube or the hollow stem enter the water chamber. The releasible closure is then used to seal the top of the water chamber.

A cigarette or cigar is then frictionally engaged with the first end of the smoke inlet tube, and ignited. The user then draws in on the hollow stem. This will create a partial vacuum in the air space above the water in the water chamber. Air will thus be drawn from space outside the water chamber, and through the cigarette or cigar. This will draw smoke through the smoke inlet tube and into the water, where it will bubble to the air space above the water in the water chamber. The smoke will thereby be filtered by the water. Once the smoke emerges from the water, it passes through the hollow stem to be inhaled by the consumer.

It has been found that filtering cigarettes through the presently claimed device significantly lowers the amount of total hydrocarbons and nicotine found in tobacco smoke. While the device is preferably used with water as the liquid filtering medium, any suitable liquid can be introduced into the water chamber.

In light of the above discussion, it is an object of the present invention to provide a water pipe for the smoking of cigarettes or cigars which removes a significant amount of total hydrocarbons and nicotine from the smoke of the cigarette.

It is another object to provide a small, easily transportable, and easily cleaned water pipe.

It is yet another object of the present invention to provide a water pipe in which there are no apertures or openings through the releasible top closure of the water pipe.

Still another object of the present invention is to provide a water pipe in which the top closure includes a central groove to ease the removal of the closure, and the central groove is dimensioned and configured so as to matingly engage the edge of a coin.

DETAILED DESCRIPTION OF THE PREFERRED EMBODIMENTS

Figure 1:
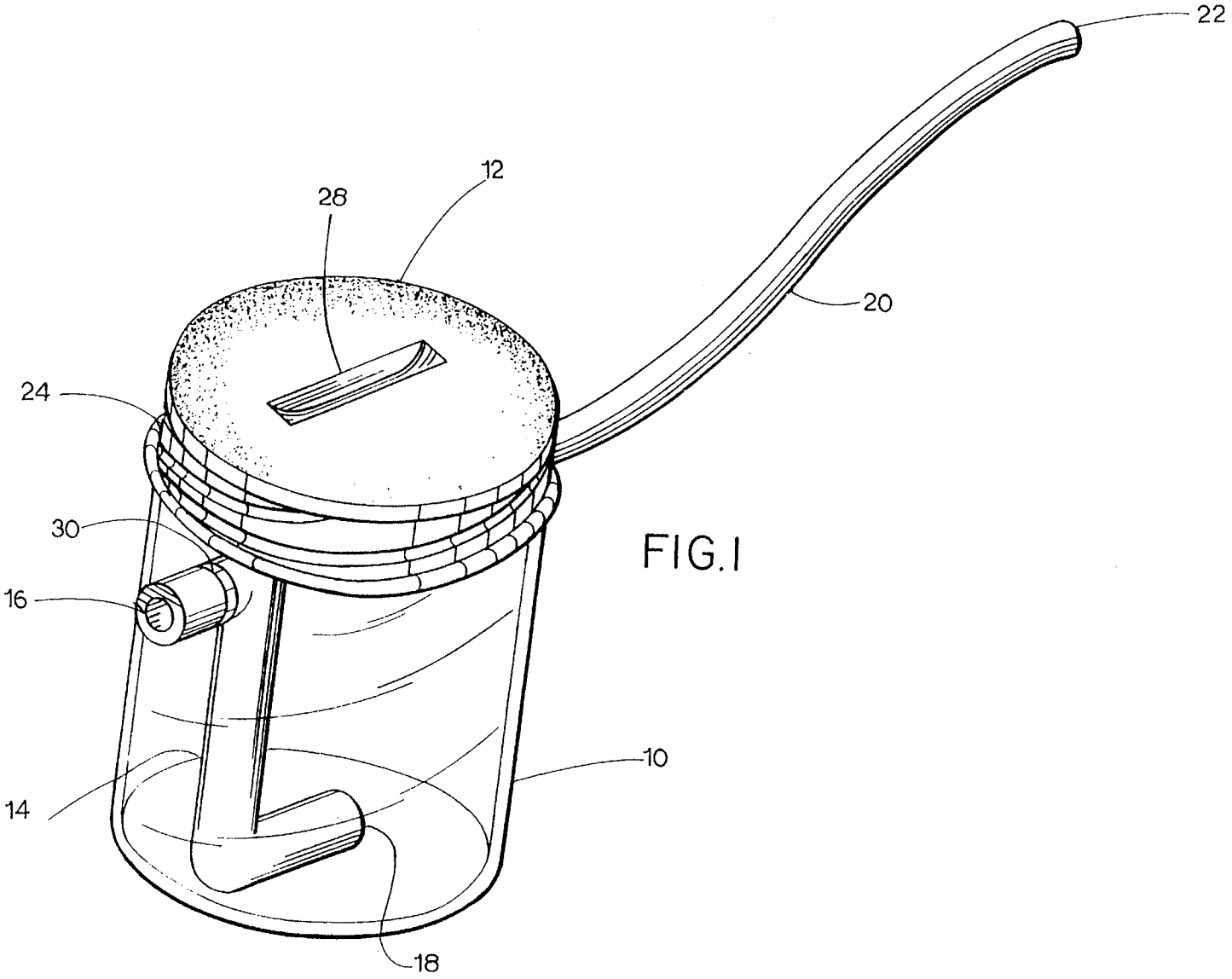
FIG. 1 is a perspective view of a water pipe according to the present invention.

Reference is made herein to the attached drawing figures. Like reference numerals are used throughout the various drawing to designate like elements of the claimed water pipe.

FIGS. 1–11 depict a water pipe according to the present invention. The water pipe includes a water chamber 10. The water chamber can be made from any suitably rigid material including glass, thermosetting and thermoplastic plastics, wood, metal, and the like. An optically transparent synthetic resin such as poly(methylmethacrylate) or polyethylene terephthalate is preferred.

The water chamber includes an open upper end which is releasably engageable with a closure 12. The closure can be made from any of the materials listed above for the water chamber, as well as more resilient materials such as natural or synthetic rubbers, elastomers, cork, and the like. The closure may be made from the same material as the water chamber, or may be made from a material different from that of the water chamber. The closure may be releasably fastened to the water chamber 10 by frictional fastening elements 24, such as by a threaded closure 12. The closure is devoid of any openings passing therethrough.

The closure 12 also may include a groove 28 situated in a central portion thereof. The groove 28 should be proportioned such that a coin, such as a nickel or dime, can easily be placed in a side-long orientation into the groove 28. In this fashion, the frictional engagement of a coin, or other flat object, with the groove 28 can be used to irotate the closure 12 to facilitate its removal from the water chamber 10.

Figure 2:
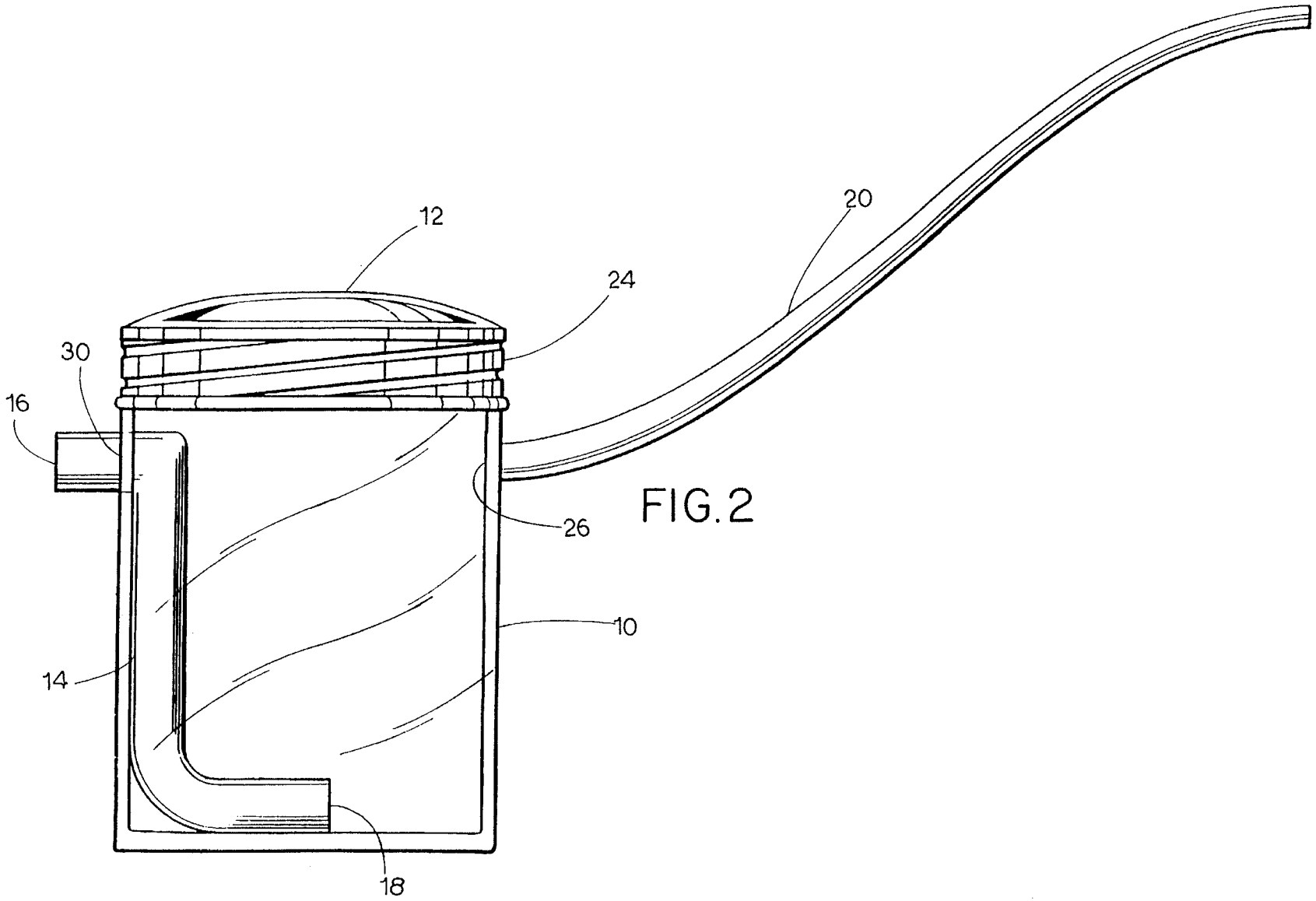
FIG. 2 is a left elevational view thereof.
Figure 4:
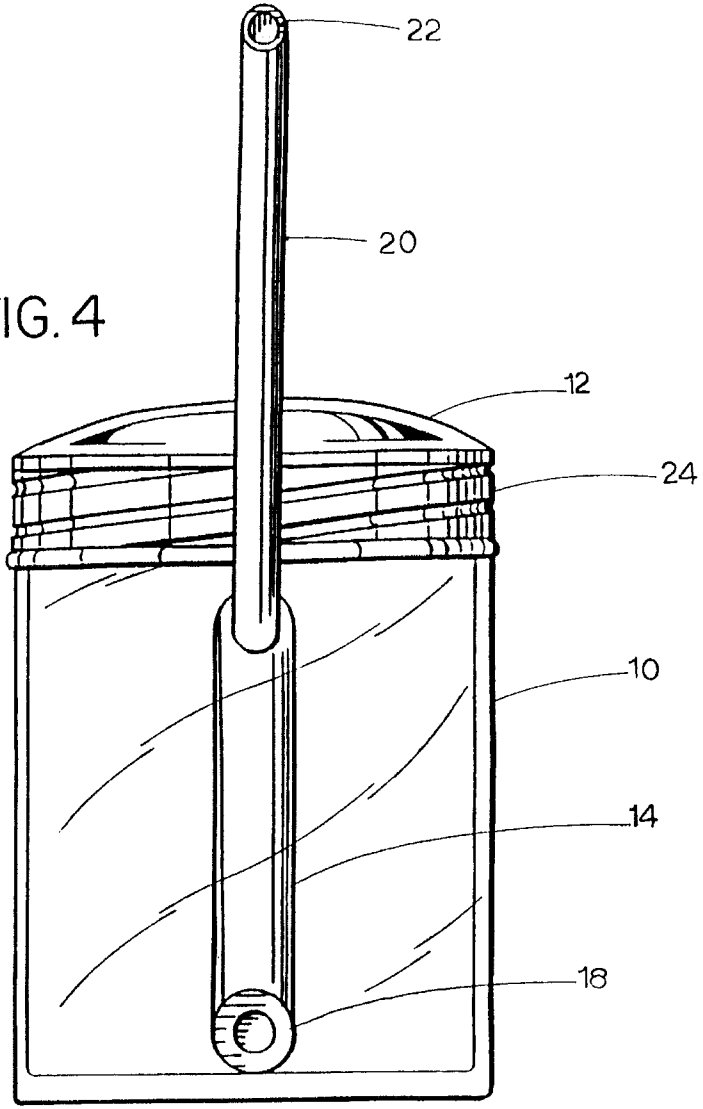
FIG. 4 is a rear elevational view thereof.
Figure 3:
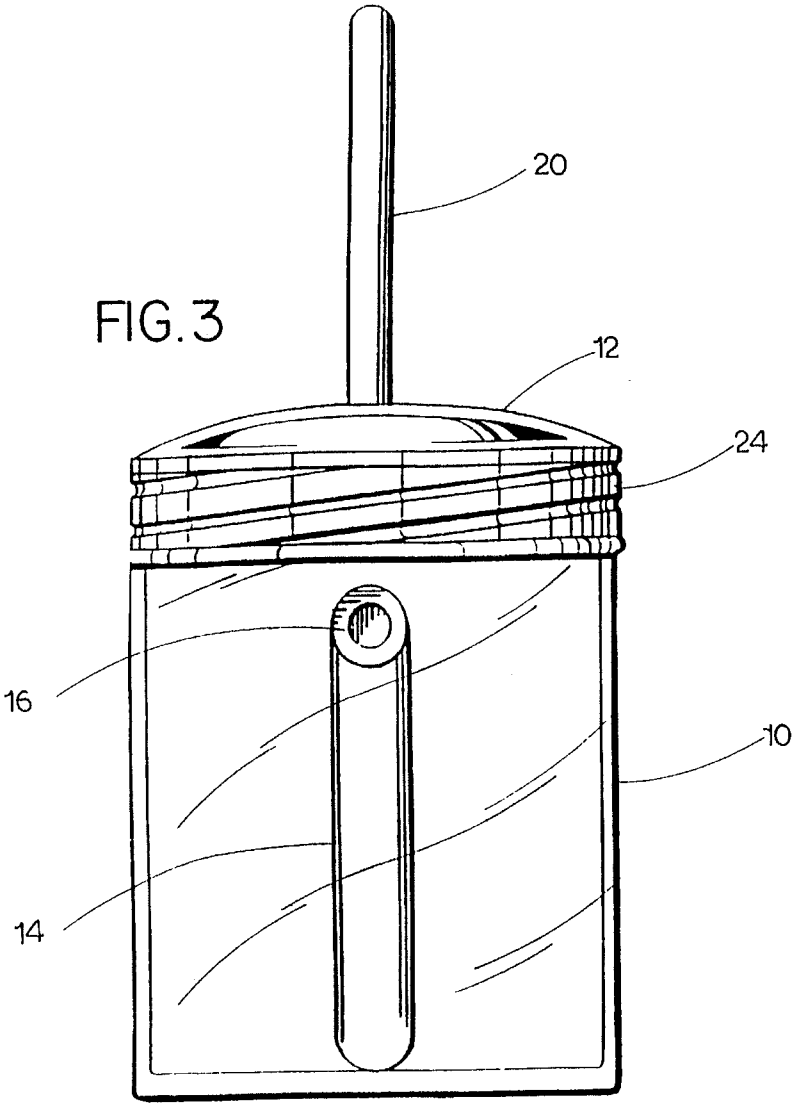
FIG. 3 is a front elevational view thereof.
Figure 5:
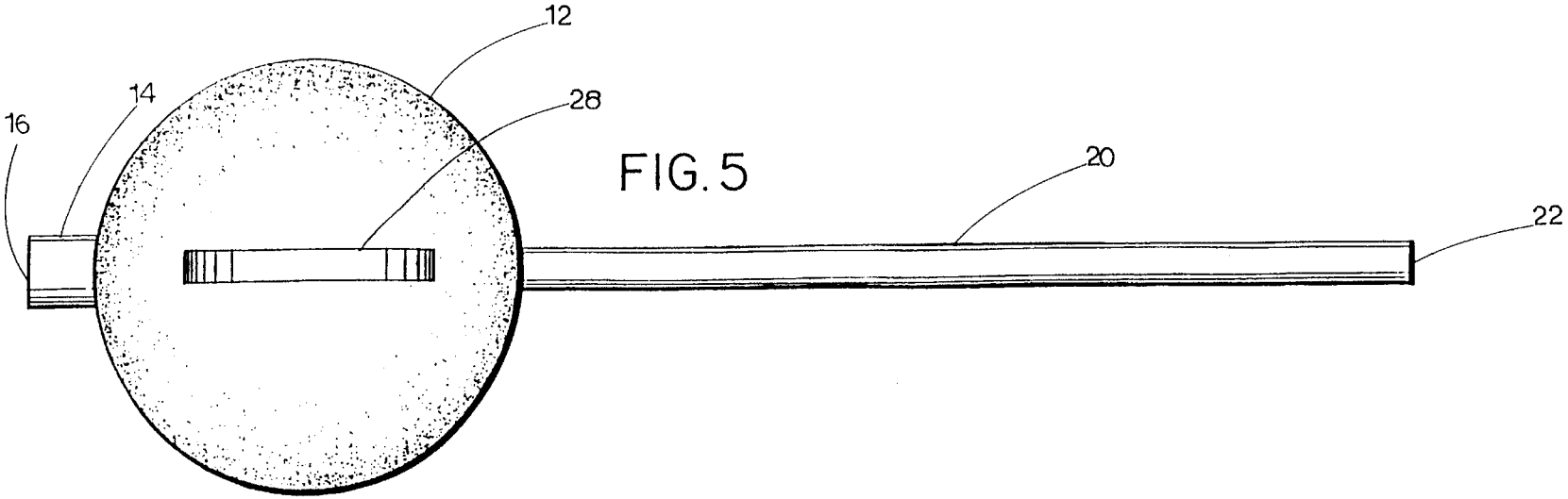
FIG. 5 is a top view thereof.
Figure 6:
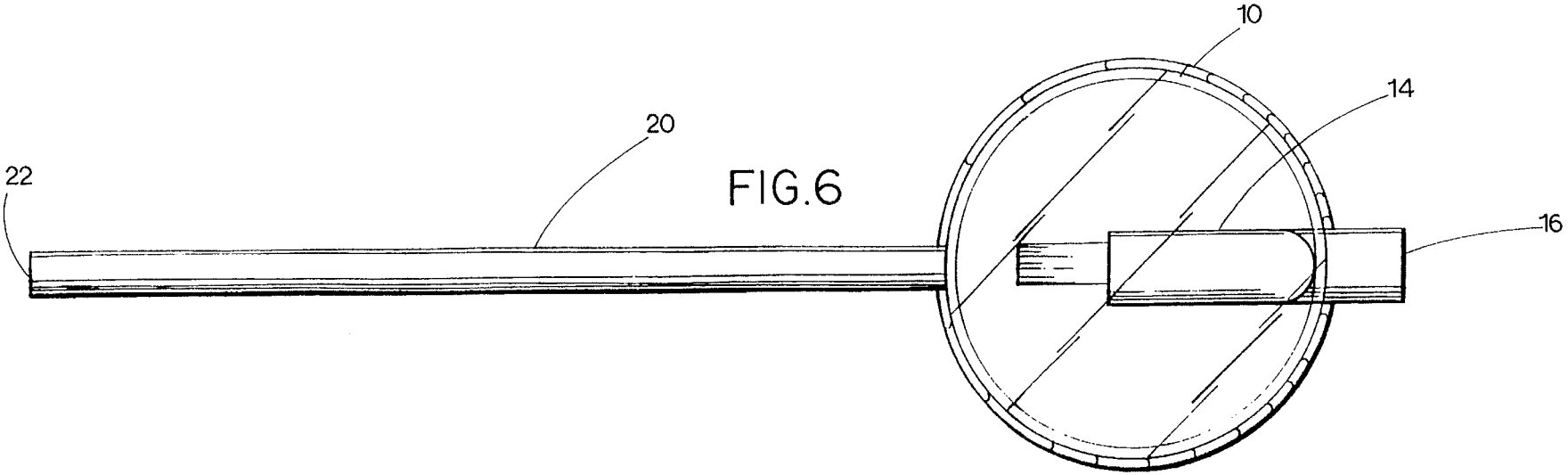
FIG. 6 is a bottom view thereof.
Figure 7:
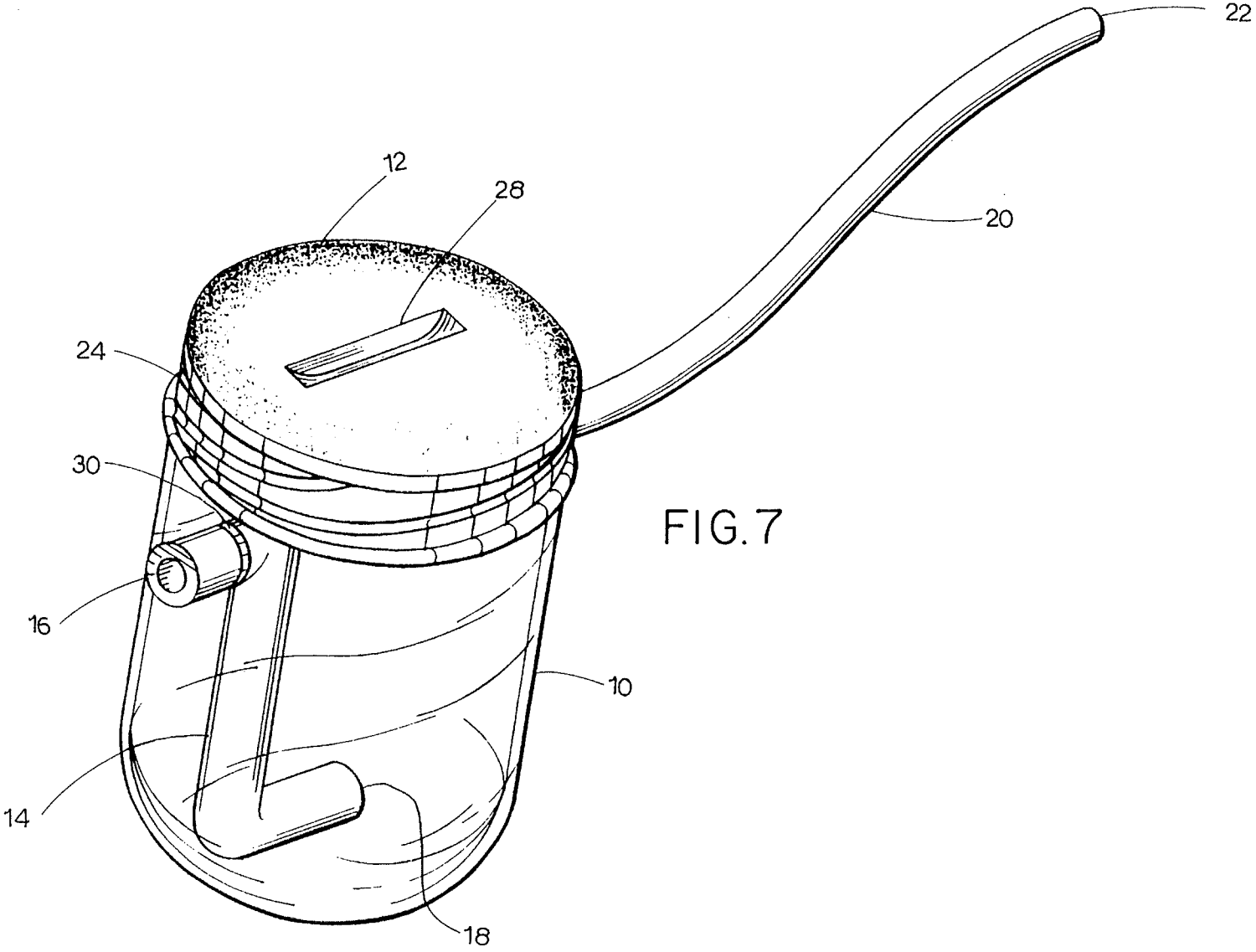
FIG. 7 is a perspective view of another water pipe according to the present invention.
Figure 8:
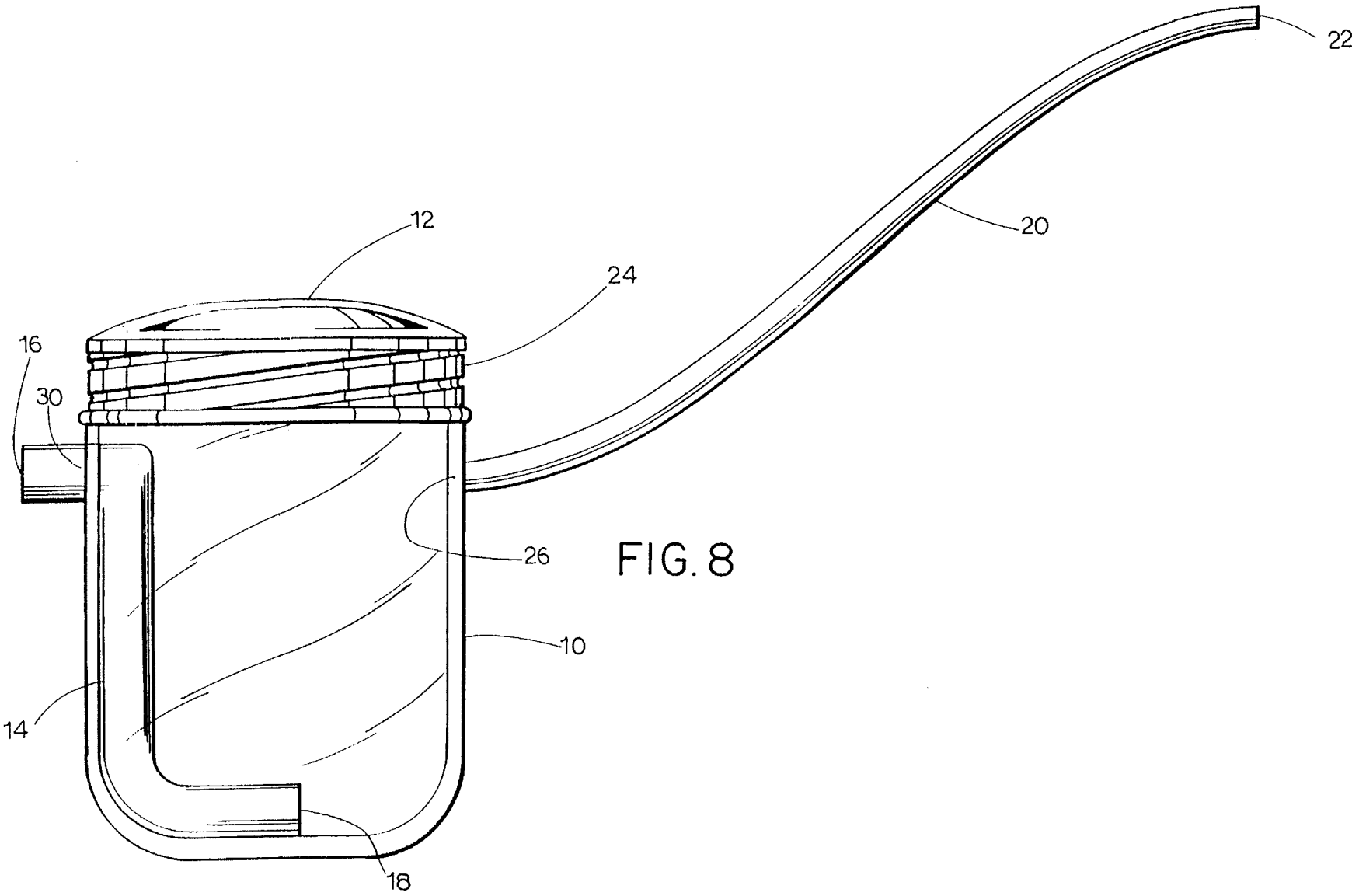
FIG. 8 is a left elevational view thereof.
Figure 10:
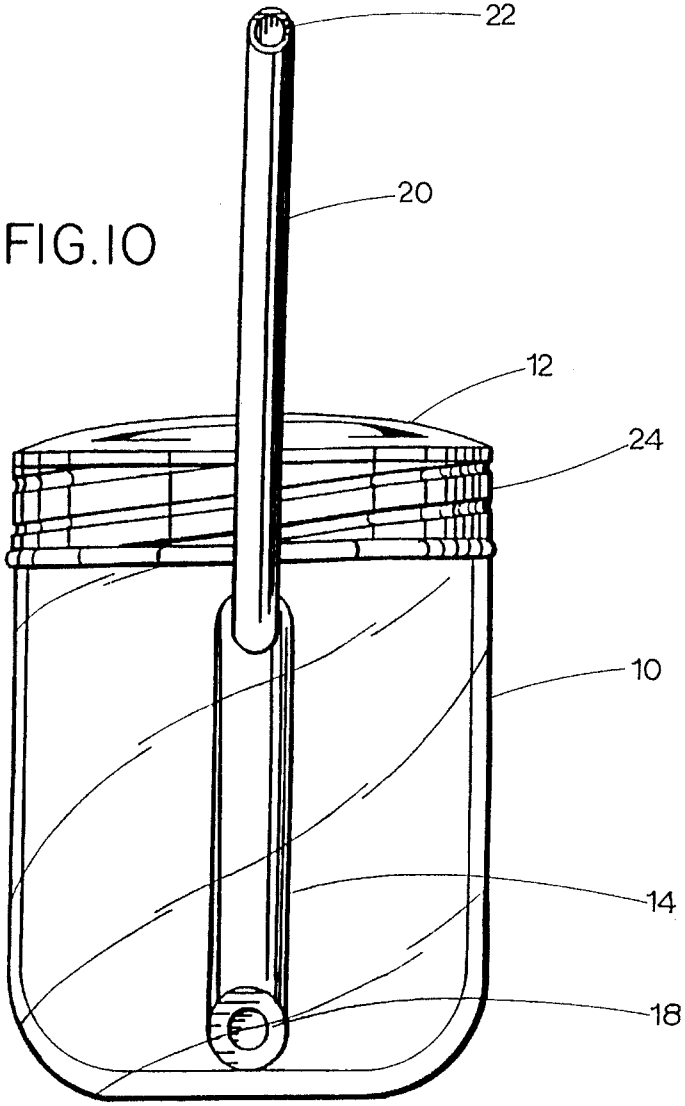
FIG. 10 is a rear elevational view thereof.
Figure 9:
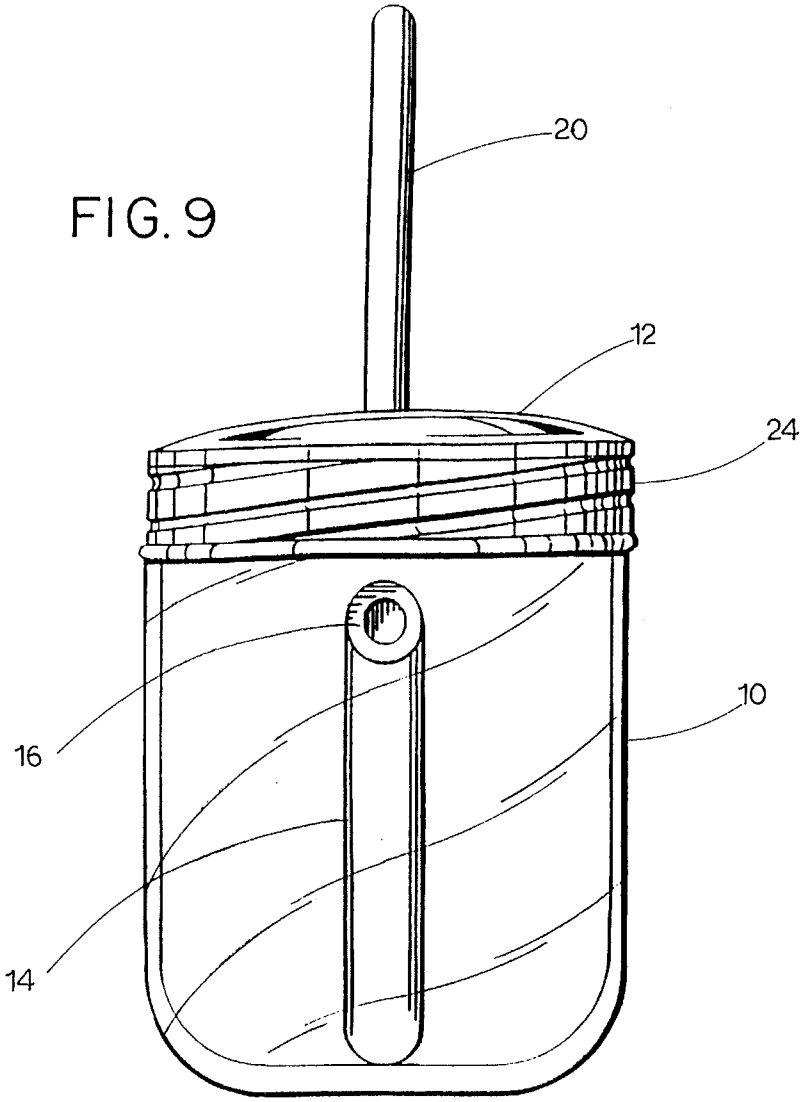
FIG. 9 is a front elevational view thereof.
Figure 11:
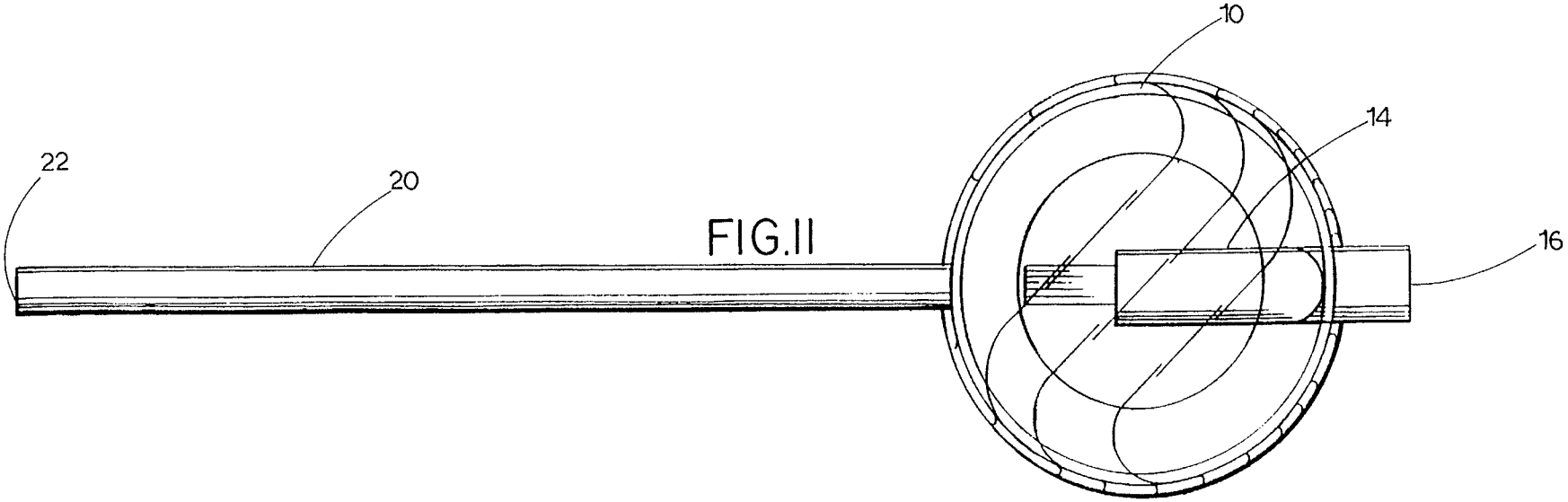
FIG. 11 is a bottom view thereof.

Referring now to FIGS. 2 and 8, the water chamber of the present invention may have a bottom surface which meets the walls of the water chamber at a substantially 90 degree angle, as depicted in FIG. 2. Or, the bottom surface of the water chamber may gently slope to meet the walls of the wetter chamber, as depicted in FIG. 8.

Continuing with FIGS. 2 and 8, the water chamber 10 includes a first opening 30 therethrough, and a second opening 26 therethrough, both of which pass through the walls of the water chamber adjacent to the open upper end of water chamber 10.

An L-shaped smoke inlet-tube 14 passes through the first opening 30. The smoke inlet tube 14 has first end 16 which is disposed outside of the water chamber, and is dimensioned and configured to be frictionally and releasably engageable with a standard tobacco cigarette or cigar. The smoke inlet tube has a second end 18 located inside the water chamber adjacent to the bottom surface of the water chamber.

A hollow stem 20 passes through the second opening 26. The stem 20 terminates in a mouthpiece 22, which is shaped to comfortably fit within the mouth of a user.

Both the smoke inlet tube and the hollow stem may be made from any suitably rigid material such as glass, thermosetting or thermoplastic resins such as polyvinylchloride, metal tubing, and the like. Both the smoke inlet tube and the hollow stem may be fabricated from semi-resilient material, so that the stem and tube may be hand-bent into a desired configuration.

The remaining drawings show different views of the water pipe, and are believed to be self-explanatory.

Analytical experiments were performed using the claimed water pipe to determine the effectiveness of the present invention to filter tar (measured as total hydrocarbons) and nicotine from cigarette smoke. The effectiveness of the water pipe was determined by measuring the mass of total hydrocarbons and nicotine present in unfiltered cigarette smoke, and cigarette smoke which had been passed through the presently claimed water pipe.

To test for total hydrocarbons, the smoke produced by burning a Camel brand unfiltered cigarette was passed through a large coconut charcoal tube. To test for nicotine, the smoke produced by burning one quarter of a Camel brand unfiltered cigarette was passed through an XAD-4 tube.

Parallel tests were performed. The control set of tests were performed on smoke passed directly from the cigarette to the sorbent material. The other set of tests were performed on smoke first passed through the presently claimed water pipe. All samples were collected at an air flow rate of approximately 1 liter per minute. The sampling flow rate was determined prior to collection of the samples based on measurements of the inhalation rate of several individuals.

Samples for determination of total hydrocarbons were collected using battery operated air sampling pumps calibrated to a flow rate of 1 liter per minute. Small dual-stage activated charcoal adsorption tubes were attached to the pumps and air was drawn through the pipe. The samples were capped after collection, and refrigerated until analyzed. The samples were analyzed using the NIOSH 1500 method for the determination of total hydrocarbons using the molecular weight and response factor of hexane. The test is performed in a gas chromatogram employing flame ionization detection to quantify the mass of hydrocarbons contained in the sample.

Samples for the determination of nicotine were also collected using battery operated air sampling pumps calibrated to a flow rate of 1 liter per minute. Dual stage XAD-4 adsorption tubes were used as a sorbent medium. The samples were capped after collection, and refrigerated until analyzed. Samples were analyzed lusing a gas chromatograph equipped with a nitrogen-phosphorous detector.

The results of the tests are presented in Table 1, below:

TABLE 1

| | Without Filter | With Filter | % Change |
|---|---|---|---|
| Total Hydrocarbons | 13,200 μg | 7,340 μg | −44% |
| Nicotine | 1340 μg | 631 μg | −53% |

The column labelled "Without Filter" designates the samples collected directly from the burning cigarette. The column labelled "With Filter" designates the sample collected from the cigarette smoke after it was passed though the present invention. As is clearly seen in the table, the presently claimed water pipe resulted in a reduction of the measured total hydrocarbons in cigarette smoke of 44%. The amount of nicotine measured in the cigarette smoke was reduced by 53%.

It is to be understood that the present invention is not to be limited in any fashion to the embodiments described above, but encompasses any and all embodiments falling within the scope of the attached claims.

We claim:

1. A water-pipe comprising:

a water chamber having a completely open upper end, a bottom surface, and walls connecting said completely open upper end and said bottom surface;

said walls of said water chamber having a first opening therethrough and a second opening therethrough, both of said first and second openings located adjacent to said completely open upper end of said water chamber;

an L-shaped smoke inlet tube passing through said first opening and having a first end and a second end and a body connecting said first and second ends, said first end terminating outside of said water chamber, and said second end terminating inside said water chamber adjacent to said bottom surface and spaced from said walls of said water chamber;

a hollow stem passing through said second opening; and a threaded closure releaseably engageable with said completely open upper end of said water chamber.

2. The water pipe according to claim 1, wherein said closure releasably engageable with said open upper end of said water chamber has a groove situated on an outside surface thereof.

3. The water pipe according to claim 2, wherein said first end of said L-shaped smoke inlet tube is dimensioned and configured to frictionally engage a smoking member selected from the group consisting of cigarettes and cigars.

4. The water pipe according to claim 1, wherein said L-shaped smoke inlet tube passes through said first opening, and extends vertically, adjacent to and in contact with a wall of said water chamber, to said bottom surface of said water chamber, and then said smoke inlet tube extends horizontally, adjacent to and in contact with said bottom surface of said water chamber, to a point equidistant from said walls of said water chamber.

5. The water pipe according to claim 4, wherein said closure releasably engageable with said open upper end of said water chamber has a groove situated on an outside surface thereof.

6. The water pipe according to claim 5, wherein said first end of said L-shaped smoke inlet tube is dimensioned and configured to frictionally engage a smoking member selected from the group consisting of cigarettes and cigars.

* * * * *